United States Patent [19]

Argyle et al.

[11] 4,291,760

[45] Sep. 29, 1981

[54] TWO FLUID HEAT EXCHANGER

[75] Inventors: Charles S. Argyle, Willowdale; Robert C. Bamsey, Kitchener; Gregory S. T. Millard, Brampton, all of Canada

[73] Assignee: Borg-Warner Corporation, Chicago, Ill.

[21] Appl. No.: 85,093

[22] Filed: Oct. 15, 1979

Related U.S. Application Data

[60] Continuation of Ser. No. 918,197, Jun. 22, 1978, abandoned, which is a division of Ser. No. 716,628, Aug. 23, 1976, abandoned.

[51] Int. Cl.[3] ..... F28F 3/00

[52] U.S. Cl. ..... 165/166; 123/570; 165/51; 165/165

[58] Field of Search ..... 165/164, 165, 166, 179, 165/51; 123/119 A

[56] References Cited

U.S. PATENT DOCUMENTS

| | | | |
|---|---|---|---|
| 2,102,581 | 12/1937 | McNeish | 165/179 X |
| 2,977,940 | 4/1961 | Theriqult . | |
| 3,360,038 | 12/1967 | Stampes | 165/166 |
| 3,865,185 | 2/1975 | Ostbo | 165/165 |

FOREIGN PATENT DOCUMENTS

| | | |
|---|---|---|
| 2404630 | 8/1974 | Fed. Rep. of Germany . |
| 2193189 | 2/1974 | France . |
| 1009178 | 11/1965 | United Kingdom . |
| 1371277 | 10/1974 | United Kingdom . |

*Primary Examiner*—Albert W. Davis
*Attorney, Agent, or Firm*—James A. Geppert

[57] ABSTRACT

A two fluid heat exchanger adapted for utilization in an exhaust gas recirculation system of an automotive internal combustion engine to reduce the temperature level of the exhaust gas from the combustion cycle that is metered from the exhaust manifold and recycled through the combustion cycle. The heat exchanger includes a plurality of generally elliptical perforated plates stacked together with end caps; each plate having a peripheral flange, an inlet opening for a first fluid defined by a flange, an outlet opening for the first fluid defined by a flange, and several elongated openings for a second fluid defined by flanges. All of the flanges project from one surface of the plate to engage the unflanged surface of the next adjacent plate with the various openings axially aligned to form continuous passages. The plates may have louvres therein, and the flanges defining the inlet and outlet openings have lateral openings therein to communicate with the spaced formed between the plates.

10 Claims, 4 Drawing Figures

111
114
118
M
112a
N
113
L
118
118
116
L 126
112
3
113
127
M
132
128
L
112a
133
131
N
129
3
111
113
115
112b
134
136
119
135
117

118
112
116
114
4
123
118
4

113
115
124
119
125
117
114
112
123
122
116
121

TWO FLUID HEAT EXCHANGER

This is a continuation, of application Ser. No. 918,197 filed June 22, 1978, now abandoned which is a division of Ser. No. 716,628, filed Aug. 23, 1976, now abandoned.

BACKGROUND OF THE INVENTION

The present invention relates to exhaust gas recirculation in the automotive internal combustion engine and more particularly to a means for cooling the exhaust gas that is returned to the combustion cycle. Since approximately 1971, automotive vehicle manufactures have been required to add an ever-increasing number of components or systems to the vehicle or the internal combustion engine therein to increase the safety of the vehicle or decrease the emissions inherent in the exhaust gases from the internal combustion engine. Such components include positive crankcase ventilation, exhaust gas recirculation, an evaporation control system and a catalytic converter in the exhaust line.

Of major concern are the emissions from the exhaust gas of an internal combustion cycle which have been blamed for conditions such as smog occurring in large cities where a large number of automobiles are present each day. The oxides of nitrogen are one such emission, and an exhaust gas recirculation cycle is used to reduce these oxides present in the engine exhaust. Formation of nitrogen oxides takes place at very high temperatures and consequently occurs during the peak temperature period of the combustion process. To reduce and control nitrogen oxides formation, only a slight reduction in peak temperature is required.

This temperature reduction can be accomplished by introducing small amounts of an inert gas into the combustion process and, as the end products of combustion provide a continuous supply of relatively inert gases, it becomes a matter of utilizing those gases in the correct proportion. Thus, a recirculation passage is connected to the exhaust manifold and to a vacuum modulated shut-off and metering valve installed on the inlet manifold to control the flow of exhaust gases. The recirculation or additional exhaust gas passage are closely positioned to the engine or may be cast into the complex runner system of the inlet manifold.

However, the exhaust gases from the internal combustion engine cycle are still at a very high temperature level and it is desirable to substantially reduce that temperature level before the gases are reintroduced into the combustion cycle. The present invention accomplishes this desired temperature reduction.

SUMMARY OF THE INVENTION

The present invention comprehends the provision of a two fluid heat exchanger and more particularly to a heat exchanger adapted to be inserted in the exhaust gas recirculation system of an automotive internal combustion engine to cool the recirculating exhaust gases before reintroduction into the inlet manifold. The heat exchanger is of a compact design to fit within the relatively crowded space in the engine compartment of the vehicle and to be easily mounted on the engine without substantially increasing the flow path of the recirculating gases.

The present invention further comprehends the provision of an two fluid heat exchanger which provides for adequate fluid flow therethrough with low resistance or pressure drop. Although primarily utilized for exhaust gas recirculation systems, the same heat exchanger could be used to extract heat from the other exhaust gas flow and for other purposes, such as a fast passenger compartment heat-up system or for a gas turbine heat exchange system, or other heat exchange situations involving two fluids. The heat exchanger is formed of suitable materials to resist corrosion and decay in the highly corrosive exhaust gas environment.

Further objects are to provide a construction of maximum simplicity, efficiency, economy and ease of assembly and operation, and such further objects, advantages and capabilities as will later more fully appear and are inherently possessed thereby.

DESCRIPTION OF THE PREFERRED EMBODIMENTS

Figures 1, 2, 3, 4:
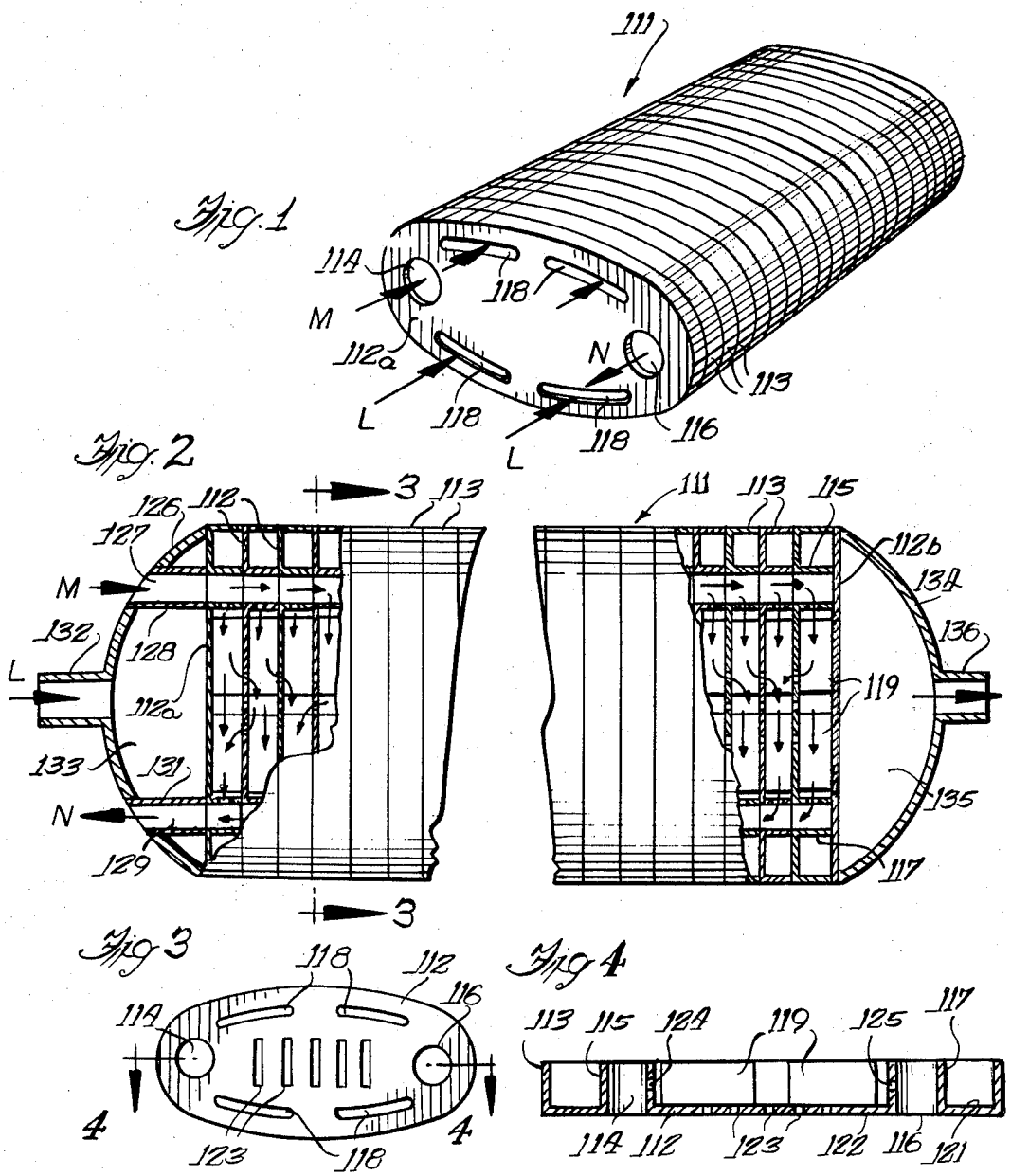
FIG. 1 is a perspective view of the heat exchanger with the ends omitted.
FIG. 2 is a top plan view of the heat exchanger of FIG. 1 including the end pieces and with the front and rear portions broken away.
FIG. 3 is a vertical cross sectional view taken on the line 3—3 of FIG. 2.
FIG. 4 is a vertical cross sectional view of a heat exchanger plate taken on the line 4—4 of FIG. 3.

Referring more particularly to the disclosure in the drawings wherein are shown illustrative embodiments of the present invention. FIG. 1 discloses heat exchanger 111 utilizing a plurality of generally elliptical perforated disks or plates 112 which are stacked together to form the heat exchanger. Each plate 112 is stamped to form a peripheral flange 113, a first fluid or gas inlet opening 114 defined by a flange 115, a first fluid or gas outlet opening 116 defined by a flange 117 and several elongated narrow openings 118 defined by flanges 119. All of the flanges 113, 115, 117 and 119 project from one surface 121 of the plate 112, and all of the plates are similarly oriented so that the flanges of one plate abut the unflanged surface 122 of the next adjacent plate. Each respective set of openings and flanges are axially aligned to form a continuous passage through the plates.

Each plate 112 may be imperforate but preferably has a series of slits or louvres 123 formed therein between the openings 114 and 116 to enhance the heat transfer from the first fluid or hot exhaust gas to the second fluid or cooling water. The front end plate **112*a* includes the first fluid or gas inlet and outlet openings 114,116 and the narrow openings 118, but without the slits, and the rear end plate 112*b* is similar to the plate 112*a* except there are no flanges or gas inlet and outlet openings. Also each flange 115,117 has one or more openings 124,125, respectively, formed therein, to allow the first fluid or exhaust gases to pass transversely across and between the plates. A domed end cap 126 is secured to the front end plate 112*a* and has an inlet conduit 127 defined by a flange 128 and an outlet conduit 129 defined by a flange 131; the flanges 128,131 being aligned with the openings 114 and 116, respectively, and secured to the plate 112*a*. A second fluid or cooling fluid inlet conduit 132 is also formed in the end cap 126 and communicates with a chamber 133 therein to distribute fluid to the openings 118. A second domed end cap 134 is secured to the end plate 112*b*** and defines a chamber 135 collecting fluid from the openings 118 for egress through a second fluid outlet conduit 136.

To assemble, the plates 112,112*a*,112*b* and the end caps 126 and 134 are stacked in a suitable jig with the flanges of one plate abutting the surface 122 of the next adjacent plate and the plates and end caps are suitably joined together, such as by brazing or soldering. The peripheral flanges 113 on the plates provide an outer shell for the heat exchanger so that it is self-contained. In use, the second fluid or cooling water enters the conduit 132 and passes through the chamber to the passages 118 (arrow L) formed by the flanges 119 at one end of the heat exchanger and exits from the opposite end into the chamber 135 and through the conduit 136. The first fluid or hot exhaust gas, however, enters the inlet conduit 127 and into the passage formed by the flanges 115 (arrow M) and fills the passage. The first fluid or gas passes through the openings 124 in the flanges 115 to flow between the plates 112 and passes through the openings 125 of flanges 117 to exit from the passage (arrow N) formed by the flanges 117 and from the heat exchanger through the conduit 129. The first fluid or gas gives up heat to the plates 112, with the slits or louvres 123 enhancing heat transfer; the heat being transferred to the second fluid or cooling water within the passages formed by flanges 119.

We claim:

1. A two fluid heat exchanger comprising a series of flanged plates, each plate having a peripheral flange, a first fluid inlet opening, a first fluid outlet opening, and one or more elongated second fluid passage openings each defined by a flange, all of the flanges on each plate extending from one surface thereof and adapted to engage the unflanged surface of the next adjacent plate, said series of plates adapted to be stacked and suitably joined together to form the heat exchanger, a pair of end plates on the opposite ends of the stack, means to allow separate flow of said first and second fluids to said plates, and separate means communicating with said first fluid inlet and outlet openings and the space between said plates, said first fluid passing through said first fluid inlet opening in each of said plates and between said plates to the first fluid outlet openings.

2. A two fluid heat exchanger as set forth in claim 1, in which said plates are generally elliptical with the first fluid inlet and outlet openings positioned adjacent the ends of the plates, and the second fluid passage openings are located adjacent the outer edges of the plates.

3. A two fluid heat exchanger as set forth in claim 1, wherein each plate includes a plurality of slits formed therein to enhance heat transfer between said first and second fluids.

4. A two fluid heat exchanger as set forth in claim 3, in which one end plate has first fluid inlet and outlet openings and second fluid passage openings without slits, and the opposite end plate has only second fluid passage openings therein.

5. A two fluid heat exchanger as set forth in claim 4, in which said one end plate includes a peripheral flange and flanges defining said first and second fluid openings, and said opposite end plate is devoid of flanges.

6. A two fluid heat exchanger as set forth in claim 4, including a domed end cap at each end of the heat exchanger and defining a chamber therein, a second fluid inlet in one end cap and a second fluid outlet in the opposite end cap.

7. A two fluid heat exchanger as set forth in claim 6, in which said one end cap includes first fluid inlet and outlet conduits communicating with the first fluid openings in said plates.

8. A two fluid heat exchanger as set forth in claim 7, in which said one end cap has first fluid inlet and outlet openings defined by inwardly extending flanges forming said conduits and engaging the surface of said one end plate.

9. A two fluid heat exchanger comprising a series of flanged plates, each plate having a peripheral flange, a first fluid inlet opening, a first fluid outlet opening, and one or more elongated second fluid passage openings each defined by a flange, all of the flanges on each plate extending from one surface thereof and adapted to engage the unflanged surface of the next adjacent plate, said series of plates adapted to be stacked and suitably joined together to form the heat exchanger, a pair of end plates on the opposite ends of the stack, means to allow separate flow of said first and second fluids to said plates, and separate means communicating with said first fluid inlet and outlet openings and the space between said plates, said aligned flanges defining the first fluid inlet and outlet openings and the second fluid openings forming a first fluid inlet passage, a first fluid outlet passage and second fluid passages, said first fluid inlet and outlet passages opening at one end of the heat exchanger, and the second fluid entering said one end of the heat exchanger and exiting from the opposite end thereof.

10. A two fluid heat exchanger as set forth in claim 9, in which said separate means includes at least one opening formed in each of said aligned flanges forming the first fluid inlet and outlet passages to allow flow of the first fluid between the first fluid inlet and outlet passages within the spacing between said plates.

* * * * *